United States Patent [19]

Imai et al.

[11] Patent Number: 4,935,402

[45] **Date of Patent: * Jun. 19, 1990**

[54] DYE-RECEIVING SHEETS FOR THERMAL DYE TRANSFER PRINTING

[75] Inventors: Akihiro Imai, Ikoma; Hiromu Matsuda; Keiichi Yubakami, both of Osaka; Nobuyoshi Taguchi, Ikoma, all of Japan

[73] Assignee: Matsushita Electric Industrial Co., Ltd., Osaka, Japan

[ * ] Notice: The portion of the term of this patent subsequent to Jun. 13, 2006 has been disclaimed.

[21] Appl. No.: 254,835

[22] Filed: Oct. 7, 1988

[30] Foreign Application Priority Data

Jun. 20, 1986 [JP] Japan ..... 61-145108

[51] Int. Cl.[5] ..... B41M 5/035; B41M 5/26

[52] U.S. Cl. ..... 503/227; 428/195; 428/212; 428/328; 428/330; 428/331; 428/423.1; 428/447; 428/480; 428/910; 428/913; 428/914

[58] Field of Search ..... 8/471; 428/195, 207, 428/323, 480, 910, 913, 914, 212, 228, 330, 331, 423.1, 447; 503/227

[56] References Cited

U.S. PATENT DOCUMENTS 4,720,480 1/1988 Ito et al. ..... 503/227
4,839,337 6/1989 Imai et al. ..... 503/227

FOREIGN PATENT DOCUMENTS 209359 1/1987 European Pat. Off. ..... 503/227
234563 9/1987 European Pat. Off. ..... 503/227
2183354 6/1987 United Kingdom ..... 503/227

OTHER PUBLICATIONS

Derwent Abstract of Japanese Reference No. 54–96052 dated Jul. 30, 1979 (JP–A–96052).
Patent Abstracts of Japan: vol. 11, No. 155 (M–589) [2602] dated May 20, 1987 (JP–A–61–284486).
Patent Abstracts of Japan: vol. 11, No. 166 (M–593) [2613] dated May 28, 1987 (JP–A–295085).
Patent Abstracts of Japan: vol. 11, No. 215 (M–606) [2662] dated Jul. 11, 1987 (JP–A–62–32085).
Patent Abstracts of Japan: vol. 11, No. 215 (M–606) [2662], dated Jul. 11, 1987 (JP–A–62–32085).

*Primary Examiner*—Bruce H. Hess
*Attorney, Agent, or Firm*—Lowe, Price, LeBlanc, Becker & Shur

[57] ABSTRACT

A dye-receiving sheet comprising a substrate and a dye-receiving layer formed on one side of the substrate, the substrate being made of an extruded, biaxially stretched sheet of a mixture of white fine particles and a polyester resin. The extruded, stretched sheet has a specific gravity of from 1.0 to 1.38. A layer of polymer having a thermal deformation temperature or softening point lower than that of the extruded, stretched sheet may be formed on the extruded, stretched sheet. The dye-receiving sheet has high brightness and good flexibility with high printing sensitivity.

19 Claims, 2 Drawing Sheets

DYE-RECEIVING SHEETS FOR THERMAL DYE TRANSFER PRINTING

BACKGROUND OF THE INVENTION

1. Field of the Invention

This invention relates to the art of thermal printing and more particularly, to dye-receiving sheets for thermal dye transfer printing on which a dye sublimating from a dye-transfer sheet is received in an imagewise pattern.

2. Description of the Prior Art

Substrates of dye-receiving sheets which are used in thermal transfer printing should have a small degree of curling when heated, and high brightness. To this end, studies have been made on extruded sheets made of mixtures of white fine particles and polyester resins because of the small degree of curling and high brightness. When, however, a dye-receiving sheet using the extruded sheet substrate and a dye transfer sheet are used in combination for the thermal transfer printing, a disadvantage is involved in that because of the rigidity or hardness of the substrate, the dye-receiving sheet and the dye transfer sheet do not contact intimately, resulting in a lowering of the print density.

SUMMARY OF THE INVENTION

An object of the invention is to provide a dye-receiving sheet which is used in sublimable dye transfer thermal printing systems using heating means such as thermal heads, laser beams, electric heating and the like and which exhibits high sensitivity for the printing.

Another object of the invention is to provide a dye-receiving sheet which makes use of an extruded, biaxially stretched resin film or sheet substrate which has a specific gravity of not larger than 1.38 whereby the dye-receiving sheet suffers little curling when heated and has high brightness with high printing sensitivity.

According to the present invention, there is provided a dye-receiving sheet which is used in combination with a sublimable dye transfer sheet and which comprises an extruded, biaxially stretched film or sheet substrate made of white fine particles and a polyester resin, and a dye-receiving layer formed on one side of the substrate. The present invention is characterized in that the substrate has a specific gravity of from 1.0 to 1.38. This invention is based on the finding that when an extruded film or sheet comprised of white fine particles and a polyester resin is biaxially stretched to such an extent that the specific gravity of the film or sheet has a specific gravity of from 1.0 to 1.38, it is improved in brightness and printing sensitivity. Presumably, this is because a smaller specific gravity results in an increasing number of voids or fine pores present in the stretched film, so that the brightness increases owing to an increasing degree of irregular reflection occurring at the voids. In addition, the increasing number of voids contribute to increase the flexibility of the film. This permits good contact of the film with a printing head, thus leading to an improvement of the printing sensitivity.

Moreover, a layer of a polymer material having a thermal deformation temperature or softening point lower than the extruded sheet should preferably be formed on at least one side of the extruded sheet. By this, the flexibility of the dye-receiving sheet is further improved. In this case, the dye-receiving layer may be formed on the extruded substrate or on the polymer material layer. The term "polymer material" used herein is intended to mean polymers per se or polymer compositions as will be described in more detail hereinafter.

DETAILED DESCRIPTION AND EMBODIMENTS OF THE INVENTION

As described above, the present invention is characterized in that the extruded, biaxially stretched resin film or sheet substrate containing white fine particles should have a specific gravity of from 1 to 1.38. Preferably, the film or sheet substrate should have a Vickers hardness of from 1.5 to 7.0 kg/mm$^2$ for imparting good flexibility.

Figure 1:
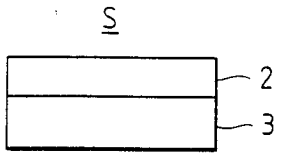
FIG. 1 is a schematic side view of a dye-receiving sheet according to one embodiment of the invention.

Reference is now made to the accompanying drawings, in which like reference numerals indicate like parts or members, and particularly to FIG. 1. In FIG. 1, there is shown a dye-receiving sheet S according to one embodiment of the invention. The dye-receiving sheet S includes an extruded, biaxially stretched resin film or sheet 3 and a dye-receiving layer 2 formed on the film or sheet 3. The extruded, stretched sheet 3 is constituted of white fine particles and a polyester resin. The sheet 3 can be readily obtained by extruding a mixture of white fine particles and a polyester resin and stretching the resultant sheet biaxially. For obtaining the sheet having a specific gravity of 1.38 or below, draw ratios, and the size and amount of the white fine particles are important. The draw ratios along the transverse and longitudinal directions may be in the range of from 2.5 to 5 although the ratios may vary depending upon the size and amount of the white fine particles. For controlling the specific gravity, it is effective to use white fine powders with different sizes in combination. For instance, when two powders having different sizes are used, an increase in amount of a larger-size powder results in a smaller specific gravity at a given level of draw ratios. This will be particularly described in Example 3.

In this manner, the specific gravity can be controlled within a range of from 1.0 to 1.38. At the same time, the Vickers hardness of the sheet should preferably be in the range of from 1.5 to 7.0 kg/mm$^2$ in order to impart a suitable degree of flexibility to the sheet.

The specific gravity is preferably not larger than 1.30 and the Vickers hardness is not larger than 5 kg/mm$^2$, more preferably not larger than 4.0 kg/mm$^2$. The sheet having preferable ranges of the specific gravity and the Vickers hardness has a high void volume and is very flexible.

It will be noted that the known extruded and stretched sheet substrates described before have a specific gravity of 1.4 or over and a Vickers hardness of not less than 8.0 kg/mm$^2$. It will also be noted that the Vickers hardness used herein is a value which is determined by the use of a load of 50 g.

Within the defined range of the specific gravity, a smaller specific gravity results in a higher void volume with more improved brightness and flexibility. That is, the brightness is improved by increasing the number of fine voids or fine pores in the sheet. Since a polyester resin is used, the sheet having a defined range of the specific gravity is resistant to heat even though the volume of the voids increases. Moreover, the increase of the void volume leads to a lowering of thermal conductivity and an increase of flexibility, thus leading to higher printing sensitivity. However, if the specific gravity is smaller than the above-defined range, the resultant sheet is undesirably apt to curl at the time of heating for printing. This curling problem may arise when the Vickers hardness is smaller than the above-defined range.

The extruded, biaxially stretched sheet 3 has preferably a thickness of from 20 to 500 micrometers.

The constituting materials for the extruded, stretched sheet 3 are described.

The particle size and kind of white fine particles are not limited, and the average size is preferably not larger than 10 micrometers. Examples of the materials for the particles include alumina, silica, calcium carbonate, magnesium carbonate, calcium silicate, titanium oxide, barium sulfate, silicones and the like. Of these, titanium oxide, barium sulfate and calcium carbonate are preferred because of the ease in obtaining a sheet having high brightness. As described before, combinations of these particles are suitably used in order to control the specific gravity of the sheet.

The white fine particles may be added in an amount of from 5 to 60 wt % of the polyester resin.

When the white fine particles are treated with surface improvers such as silane coupling agents, titanate coupling agents, aluminum coupling agents and the like, the dispersability of the treated particles or the flexibility of the resultant extruded sheet is improved, leading to better results. Furthermore, if a fluorescent brighteners or antistatic agents are added for use in combination with the white fine particles, the resultant sheet has improved brightness and improved electrostatic properties at the time of printing.

The polyester resins used for the extruded, stretched sheet are not critical and are preferably polyethylene terephthalate resins, polyethylene naphthalate resins and the like. The dye-receiving layer 2 is formed on the sheet 3.

Figure 2:
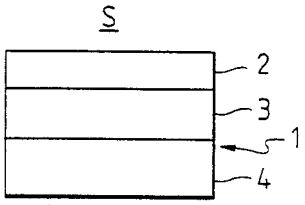
FIGS. 2, 3 and 4 are similar to FIG. 1, showing dye-receiving sheets according to further embodiments of the invention, respectively.

Prior to describing the dye-receiving layer 2, another embodiment of the invention is illustrated with reference to FIG. 2 only for convenience's sake. In this embodiment, a substrate 1 is a composite sheet including the extruded, stretched sheet 3 and a layer 4 of a polymer material as shown. The polymer layer 4 is formed on at least one side of the extruded, stretched sheet 3. This layer is made of a polymer material or polymer composition whose thermal deformation temperature or softening point is lower than that of the extruded, stretched sheet. The layer of the polymer material or composition may be formed on the extruded, stretched sheet by coating, lamination and other known techniques. When various synthetic papers are, for instance, laminated on the extruded sheet through an adhesive layer, a composite substrate of good properties can be obtained.

The polymer layer may have a multi-layered structure in which at least one layer should be made of a polymer material or polymer composition whose thermal deformation temperature or softening point is lower than that of the extruded sheet. In this connection, the laminated substrate using an adhesive layer may be considered as a kind of multi-layered structure.

The thermal deformation temperature or softening point may be determined either before a polymer material or polymer composition is applied onto the extruded sheet, or after the application.

The term "thermal deformation temperature" used herein is intended to mean a temperature which is determined according to the method prescribed in ASTM D648 in which a load of 18.6 kg/cm$^2$ is used.

Likewise, the term "softening point" may be a temperature which is determined according to the Vicat softening point test method, the flow tester method (using, for example, Shimadzu Flow Tester CFT-500, available from Shimadzu Corporation) or a penetration test using a thermomechanical analyzer (using, for example, TM-7000 of Shinku-Riko Inc.). For comparison between the extruded sheet and the polymer material or composition with respect to the softening point or thermal deformation temperature, the same measuring method should be used.

Especially, when the difference in the thermal deformation temperature or softening point between a polymer material or composition and the extruded sheet is 20° C. or over, good results are obtained.

The polymer materials may be various synthetic and natural resins including, for example, polyethylene, polypropylene, vinyl chloride resins, vinylidene chloride resins, ionomer resins, vinyl chloride copolymers such as, for example, vinyl chloride-vinyl acetate copolymers, vinyl chloride-vinylidene chloride copolymers and the like, ethylene copolymers such as, for example, ethylene-vinyl acetate copolymers, ethylene-acrylic acid copolymers, ethylene-ethyl acrylate copolymers, ethylene-ethyl methacrylate copolymers, ethylene-methyl acrylate copolymers and the like, polystyrene, polyvinyl butyral, polyurethanes, polyamides, polyesters, rosin, rosin derivatives, terpene resins, petroleum hydrocarbon resins, and the like. These polymer materials may be used singly or in combination, or may further comprise various additives such as fillers, surface active agents and the like, thereby giving polymer compositions.

The dye-receiving layer 2 is a layer which contains at least a resin on which a dye, particularly a disperse dye, sublimating from a dye transfer sheet is likely to deposit. In particularly, a preferable dye-receiving layer 2 is made of polyester resins, acrylic resins, epoxy resins, urethane resins and the like. These resins are usually formed by coating techniques. For this purpose, aqueous paints or non-aqueous paints using organic solvents may be used. As a matter of course, an anchor coating may be applied prior to coating of the paints.

One of preferable dye-receiving layers is a layer which is obtained by applying an aqueous paint comprising the following ingredients (a), (b) and (c) on the substrate: (a) a dye-receiving resin soluble or dispersable in water; (b) an aqueous dispersion of a mixture of a silane copolymer having silane units therein in the form of an emulsion and colloidal silica; and (c) a releasing surface active agent soluble in water.

The water-soluble or dispersable dye-receiving resin (a) is a resin which has high affinity for sublimable dyes and is capable of stably receiving the dye. Examples of such resins include saturated linear polyester resins, epoxy resins, cellulose acetate resins, polyamide resins, urethane resins and the like.

The silane copolymers used in the dispersion (b) should preferably have hydrolyzable groups which are able to react with the colloidal silica, and may be copolymers of vinyl silane monomers and acrylic monomers. These copolymers are prepared by emulsion copolymerization of these monomers in the presence of anionic or nonionic surface active agents. Specific examples of these copolymers include copolymers of vinyl trimethoxysilane/butyl acrylate/methyl methacrylate, vinyl triethyoxysilane/2-ethylhexyl acrylate/-methyl methacrylate, vinyl methoxysilane/butyl acrylate/styrene, vinyl triacetoxysilane/butyl acrylate/methyl acrylate, and the like.

The collodial silica may be a sol of ultrafine silica powder having a primary particle size of from 5 to 50 μm and is usually added to the silane copolymer emulsion in an amount of from 1 to 200 parts by weight per 100 parts by weight of the solid copolymer. The colloidal silica may be added to the emulsion during the emulsion polymerization or after formation of the emulsion.

The water-soluble, releasing surface active agents have the effect of preventing the fusion between the dye or colorant layer of a dye transfer sheet and the dye-receiving layer of the dye-receiving sheet as will occur during thermal printing. Typical examples of the agents include various organic surface active agents, silicone surface active agents, fluorine-containing surface active agents and the like.

The mixing ratios of these ingredients (a), (b) and (c) in the aqueous paint are not critical, but better results are obtained when the ingredient (a) as a solid is used in an amount of from 50 to 90 wt % of the total solids in the aqueous paint. The ingredient (c) is generally used in amounts not larger than 10 wt % of the total solids in the aqueous paint.

Alternatively, the dye-receiving layer may be formed of a cured product of a curable resin, or a composition comprising such a cured product. This type of dye-receiving layer is favorable because of the good adhesion with the substrate. Curable resins may be resin compositions comprising curing initiators, sensitizers and the like, if necessary, and can be cured by application of heat, high frequency energy, corpuscular radiation and combinations thereof. Various curable resins which can be cured with the aid of curing initiators such as isocyanates, melamine resins, epoxy resins and the like, may be used in the practice of the invention. Examples of these types of curable resins include saturated copolymerized polyester resins, xylene resins, butyral resins and the like. Other curable resins include, for example, various acrylate resins such as polyol acrylates, polyester acrylates, polyester urethane acrylates, epoxy acrylates, urethane acrylates, silicone acrylates, polyacetal acrylates and the like, alicyclic epoxy resins, bisphenol-type epoxy resins, and the like. Of these, polyester urethane acrylate resins which have poor adhesion to a polyethylene terephthalate film are very useful in good adhesion to the substrate used in the present invention.

In particular, polyester urethane acrylate resins of the following general formula can yield a dye-receiving layer which has a high heat resistance, good dye receptivity without involving any bleeding of dye, and good adhesion to the substrate

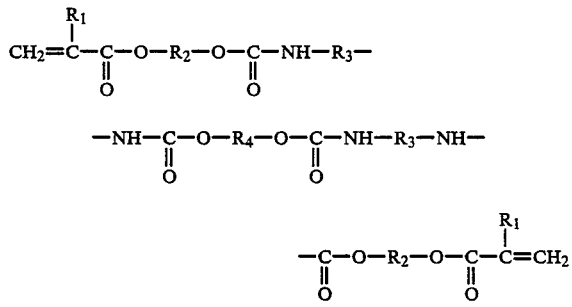

in which each $R_1$ represents —H or —$CH_3$, each $R_2$ represents a dihydric alcohol residue, each $R_3$ represents an organic diisocyanate residue, and $R_4$ represents a residue of a polyester having a hydroxyl group at both ends and a molecular weight not larger than 3,000.

The dihydric alcohol residue represented by $R_2$ is a group derived from a compound having two alcoholic hydroxyl groups. Examples of such compounds include ethylene glycol, 1,2-propanediol, 1,3-propanediol, 2,2-dimethyl-1,3-propanediol, 1,3-butanediol, 1,4-butanediol, 1,5-pentanediol, 1,6-hexanediol, 1,9-nonanediol, 1,4-cyclohexanediol and the like. Preferably, the dihydric alcohols are those having not larger than 6 carbon atoms because of the high heat resistance.

The organic diisocyanate residues represented by $R_3$ are groups derived from organic diisocyanates. The organic diisocyanates include, for example, tolylene diisocyanate, naphthylene diisocyanate, pyrene diisocyanate, nitrodiphenyl diisocyanate, diphenylsulfone diisocyanate, diphenylmethane diisocyanate, tolylene diisocyanate dimer, isophorone diisocyanate, xylylene diisocyanate, hexamethylene diisocyanate, methylenebis(4-cyclohexyl isocyanate) and the like. Of these, tolylene diisocyanate having good characteristic properties and isophorone diisocyanate, xylylene diisocyanate, hexamethylene diisocyanate and methylenebis(4-cyclohexyl isocyanate), which do not undergo any yellowing, are preferred.

The residue of the polyester represented by $R_4$ is a group derived from a polyester which is prepared from a polybasic acid and a polyhydric alcohol, and should have a molecular weight not larger than 3,000. The polybasic acids may be saturated and/or unsaturated polybasic acids and mixtures thereof. Examples of the saturated polybasic acids include succinic acid, adipic acid, pimelic acid, azelaic acid, sebacic acid, phthalic acid, isophthalic acid, terephthalic acid and the like, and examples of the unsaturated polybasic acids include maleic acid, fumaric acid, itaconic acid and the like.

The polyhydric alcohols are compounds having at least two alcoholic hydroxyl group and include not only the dihydric alcohols indicated before, but also trimethylolpropane, 1,2,6-hexanetriol, pentaerythritol, glycerine and the like. These alcohols may be used singly or in combination.

Figure 3:
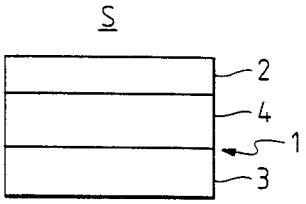
Figure 4:
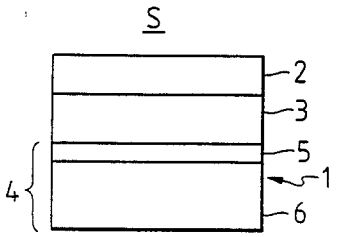

Further embodiments of the invention are shown in FIGS. 3 and 4. In FIG. 3, there is shown a dye-receiving sheet S in which the dye-receiving layer 2 is formed on the polymer layer 4 of the composite film substrate 1. In other words, the polymer layer 4 is formed between the dye-receiving layer 2 and the extruded sheet 3. In the embodiment shown in FIG. 4, the polymer layer 4 is made of an adhesive layer 5 and a synthetic paper 6, which adhesive layer is used for lamination of the synthetic paper 6 on the extruded sheet 3, thereby forming a composite film substrate 1. The dye-receiving layer 2 is formed on the extruded sheet 3, but may be formed on the synthetic paper 6.

The thickness of the polymer layer 4 may be at least about 1 micrometer when the layer 4 is sandwiched between the extruded sheet 3 and the dye-receiving layer 2 as shown in FIG. 3. If, however, the polymer layer 4 is formed on opposite side with respect to the dye-receiving layer 2 as in the cases of FIGS. 1 and 3, good results are obtained at a thickness of about 1/10 of the thickness of the extruded sheet.

The present invention is more particularly described by way of examples. A comparative example is also shown.

EXAMPLE 1

A mixture of a polyethylene terephthalate resin and barium sulfate powder used in an amount of 21 wt % of the resin was subjected to extrusion and biaxial stretching at a draw ratio of 3.5 in biaxial directions to obtain an extruded, biaxially stretched sheet having a Vickers hardness of 4.80 kg/mm$^2$, a specific gravity of 1.30 and a thickness of 75 micrometers. An aqueous emulsion of a polyester resin (MD1200, available from Toyobo Co., Ltd.) was applied onto one side of the sheet in a thickness of about 0.5 micrometers for anchor coating. Thereafter, a coating paint comprised of 100 parts by weight of a polyester resin (MD1200), 90 parts by weight of colloidal silica (Snowtex 40, available from Nissan Chemical Industries, Ltd.), and 0.4 parts by weight of a surface active agent (L7001, available from Nippon Unicar Co., Ltd.) were coated onto the anchor coating to form an about 3 micrometer thick dye-receiving layer.

Separately, a dye transfer sheet was obtained by coating, on one side of a 4 micrometer thick polyamide film, an ink composition comprising 3 parts by weight of a sublimable disperse dye of the following structural formula, 4 parts by weight of a polycarbonate resin, and 100 parts by weight of methylene chloride

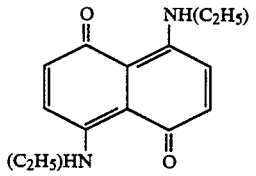

The dye-receiving sheet and the dye transfer sheet were placed between a thermal head and a platen of a printing apparatus so that the dye-receiving layer and the ink layer were arranged to face each other, and printed at a load of about 4 kg under the following printing conditions.

Main and sub-scanning dot density: 4 dots/mm
Printing power: 0.7 W/dot
Heating time of the head: 8 ms.

The resultant record on the dye-receiving sheet had a print density of 1.44.

EXAMPLE 2

A 75 micrometer thick, extruded, biaxially stretched sheet as used in Example 1 was coated with a coating composition comprised of 25 parts by weight of an ethylenevinyl acetate copolymer resin (360, from Mitsui Polychemicals Co., Ltd.), 10 parts by weight of calcium carbonate (Whiton SB, available from Shiraishi Calcium Kaisha Ltd.) and 75 parts by weight of toluene was applied onto one side of the extruded sheet to form a 25 micrometer thick polymer layer.

An aqueous dispersion of 66.6 parts by weight of a polyester resin emulsion (Vylonal MD-1200, available from Toyobo Co., Ltd.), 31.6 parts by weight of an emulsion of a silane polymer containing colloidal silica (Mowinyl 8020, Hoechst Gosei Co., Ltd.), and 1.8 parts by weight of a surface active agent (PEG6000S, available from Sanyo Chemical Industries, Ltd.) was applied onto the polymer layer by means of a wire rod and dried to obtain a dye-receiving sheet having an about 6 micrometer thick dye-receiving layer.

The printing was effected using the same dye transfer sheet and printing conditions as used in Example 1, with the result that the print density was 1.60.

COMPARATIVE EXAMPLE

A 75 micrometer thick extruded and biaxially stretched sheet made of barium sulfate and a polyethylene terephthalate and having a Vickers hardness of 8.50 kg/mm$^2$ and a specific gravity of 1.40 was provided, on which an about 0.5 micrometer thick anchor coating and an about 3 micrometer thick dye-receiving layer were formed in this order in the same manner as in Example 1 to obtain a dye-receiving sheet. The printing was effected using the same dye transfer sheet and printing conditions as used in Example 1, with the result that the print density of the sheet was 1.30. The brightness of the substrate was lower than that of the substrate of Example 1.

EXAMPLE 3.

A mixture of 100 parts by weight of polyethylene terephthalate resin, 0.01 part by weight of a fluorescent brightener and 23 parts by weight of barium sulfate powder having an average size of 0.5 micrometers was extruded and subsequently biaxially stretched to obtain an extruded, biaxially stretched sheet having a specific gravity of 1.40. The above procedure was repeated using, instead of the barium sulfate, a mixture of 20 parts by weight of barium sulfate powder having an average size of 0.5 micrometers and 3 parts by weight of barium sulfate powder having an average size of 1 micrometer, a mixture of 20 parts by weight of barium sulfate powder having an average size of 0.5 micrometers and 6 parts by weight of barium sulfate powder having an average size of 1 micrometer, and a mixture of 20 parts by weight of barium sulfate powder having an average size of 0.5 micrometers and 8 parts by weight of barium sulfate powder having an average size of 3 micrometers, thereby obtaining extruded, biaxially stretched sheets having specific gravities of 1.38, 1.36 and 1.26, respectively.

It was found through visual observation that a smaller specific gravity sheet was better with respect to brightness.

Figure 5:
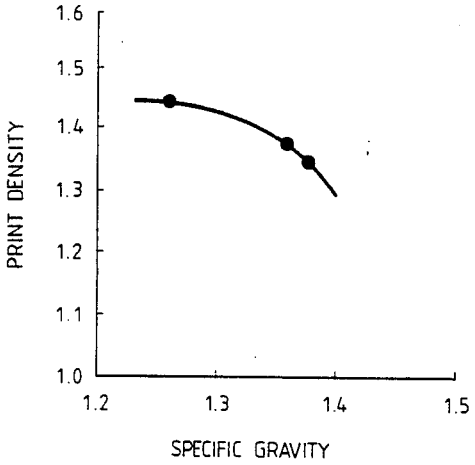
FIG. 5 is a graph showing a print density in relation to the variation in specific gravity of an extruded, biaxially stretched resin sheet.

Thereafter, a dye-receiving layer was formed on each of the sheets in the same manner as in Example 1. These sheets were subjected to measurement of print density as in Example 1. The results are shown in FIG. 5, revealing that the sheet having a specific gravity of 1.40 is poorer than the other sheets having smaller specific gravitites.

Further, it was also found that when the specific gravity was 1.30 or below, the print density was kept almost constant at a high level. Thus, the sheet having a specific gravity of not larger than 1.38, preferably not larger than 1.30, can significantly improve the print density.

What is claimed is:

1. In a dye-receiving sheet which is used in combination with a sublimable dye transfer sheet and which comprises an extruded, biaxially stretched sheet made of white fine particles and a polyester resin, and a dye-receiving layer formed on the extruded, biaxially stretched sheet, an improvement in that said extruded, biaxially stretched sheet has a specific gravity of from 1.0 to 1.38.

2. A dye-receiving sheet according to claim 1, wherein said extruded, stretched sheet has a specific gravity of not larger than 1.30.

3. A dye-receiving sheet according to claim 1, wherein said white fine particles are made of titanium oxide.

4. A dye-receiving sheet according to claim 1, wherein said white fine particles are made of barium sulfate.

5. A dye-receiving sheet according to claim 1, wherein said white fine particles are made of calcium carbonate.

6. A dye-receiving sheet according to claim 1, wherein said white fine particles are treated with a surface improver selected from the group consisting of silane, titanate and aluminum coupling agents.

7. A dye-receiving sheet according to claim 1, wherein said polyester resin is a polyethylene terephthalate resin or a polyethylene naphthalate resin.

8. A dye-receiving sheet according to claim 1, wherein said dye-receiving layer is a layer formed from an aqueous composition comprising a water-soluble or water-dispersable dye-receiving resin, an aqueous dispersion of colloidal silica in a silane copolymer emulsion, and a surface active agent.

9. A dye-receiving sheet according to claim 8, wherein said dye-receiving resin is contained in an amount of from 50 to 90 wt % of the total solids in said aqueous composition.

10. A dye-receiving sheet according to claim 8, wherein the silane copolymer has hydrolyzable groups which are able to react with the colloidal silica.

11. A dye-receiving sheet according to claim 1, wherein said dye-receiving layer is made of a cured resin.

12. A dye-receiving sheet according to claim 1, wherein said dye-receiving layer is made of a cured product of a polyester urethane acrylate of the following formula

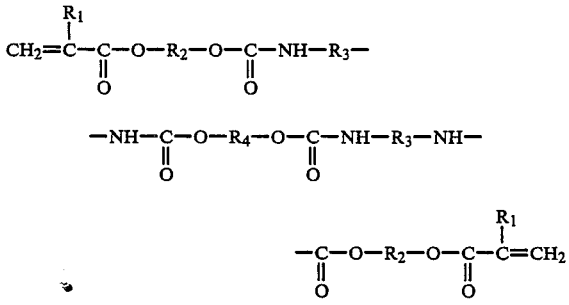

in which each $R_1$ represents —H or —$CH_3$, each $R_2$ represents a dihydric alcohol residue, each $R_3$ represents an organic diisocyanate residue, and $R_4$ represents a residue of a polyester having a hydroxyl group at both ends and a molecular weight of not larger than 3000.

13. A dye-receiving sheet according to claim 12, wherein said dihydric alcohol residue $R_2$ contains not greater than 6 carbon atoms.

14. A dye-receiving sheet according to claim 12, wherein said organic diisocyanate represented by $R_3$ is a member selected from the group consisting of tolylene diisocyanate, isophorone diisocyanate, hexamethylene diisocyanate and methylenebis(4-cyclohexyl isocyanate).

15. A dye-receiving sheet according to claim 1, wherein said extruded, biaxially stretched sheet has a Vickers hardness of not larger than 7 kg/mm$^2$ whereby the resultant sheet has flexibility sufficient for thermal printing.

16. A dye-receiving sheet according to claim 1, further comprising a layer of a polymer formed on at least one side of said extruded, biaxially stretched sheet, said polymer having a thermal deformation temperature or softening point lower than said extruded, biaxially stretched sheet.

17. A dye-receiving sheet according to claim 16, wherein the polymer layer is laminated on said at least one side through an adhesive layer.

18. A dye-receiving sheet according to claim 16, wherein the polymer layer has a multi-layered structure which includes a sub-layer of a polymer whose thermal deformation temperature or softening point is lower than said extruded, stretched sheet.

19. A dye-receiving sheet according to claim 16, wherein the dye-receiving layer is formed on the polymer layer.

* * * * *